US005554076A

United States Patent [19]

Clark

[11] Patent Number: 5,554,076

[45] Date of Patent: Sep. 10, 1996

[54] METHOD OF USING A BOWLER'S FINGER SLEEVE

[76] Inventor: E. Nelson Clark, 533 Devonshire Dr., Hollidaysburg, Pa. 16648

[21] Appl. No.: 451,809

[22] Filed: May 26, 1995

[51] Int. Cl.[6] ..... A63D 5/00; A63B 71/14

[52] U.S. Cl. ..... 473/61; 2/21

[58] Field of Search ..... 473/59, 61, 127, 473/128; 602/22, 61; 2/16, 21, 161.1, 163, 169; 128/880

[56] References Cited

U.S. PATENT DOCUMENTS 4,194,736 3/1980 Loafman .
4,270,528 6/1981 Hanson ..... 128/87 A
4,273,330 6/1981 Buneta .
4,371,163 2/1983 Shaffer et al. .
4,441,711 4/1984 Dubar et al. .
4,531,735 7/1985 Kovacs .
5,095,897 3/1992 Clark et al. .
5,172,910 12/1992 Ashurst .

*Primary Examiner*—William M. Pierce
*Attorney, Agent, or Firm*—Griffin, Butler Whisenhunt & Kurtossy

[57] ABSTRACT

A bowler's finger sleeve (10) is constructed of a high density neoprene sheet to form a curved tube which is placed on a bowler's finger (12) to aid the bowler in controlling a bowling ball (16). The sleeve is constructed using a method employed to construct a prior art orthopedic splint. An internal ridge (52) of the sleeve is placed at a dorsal surface (56) of the bowler's finger.

8 Claims, 3 Drawing Sheets

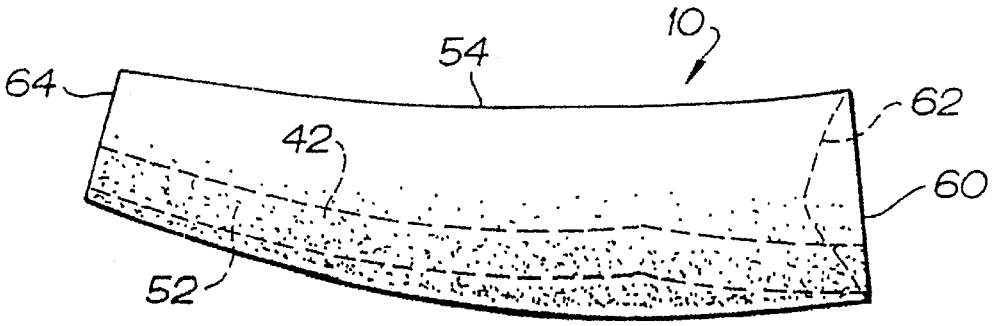
FIG. 1
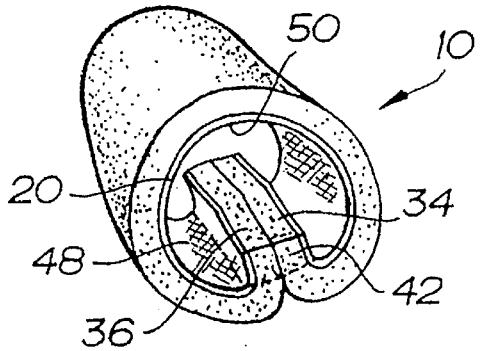
FIG. 2
FIG. 3
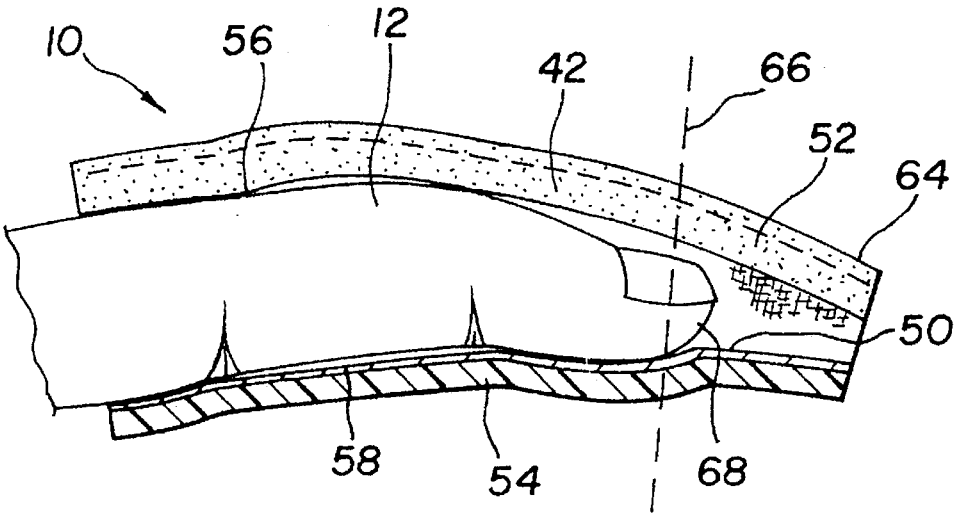

METHOD OF USING A BOWLER'S FINGER SLEEVE

BACKGROUND OF THE INVENTION

This invention relates generally to finger aids for sportsmen, and more specifically to finger sleeves for bowlers which are worn by bowlers on their fingers when they grip, manipulate, and release bowling balls.

Bowling is a popular sport enjoyed by a wide variety of people of all ages and sexes. The art of bowling requires one to deliver a ball weighing in range of 12 to 16 lbs. for average adult bowlers. In order for a bowler to be successful, his ball must be delivered at a precise point at the beginning of a lane, with his finger digits controlling his grip and delivery of the ball. His finger positioning and finger contact with the ball assist in controlling the ball to perform required maneuvers.

Numerous bowling supports and devices have been proposed to aid average bowlers position their fingers and wrists to enhance their grips.

U.S. Pat. No. 4,371,163 to Shaffer et al. discloses a forefinger, or index finger, extension of a rigid material having a resilient layer of sponge rubber thereon (see column 2, line 29 of this patent).

U.S. Pat. No. 4,441,711 to Dubar et al. discloses an extension at an angle of from 10° to 25°, preferably around 20° (see column 2, line 65 of this patent). It is also mentioned in this patent that a second tip portion of the extension lies at an angle of 35° to 55°, preferably about 45°, to a plane of a body. This extension appears to be on a ring finger of a bowler.

U.S. Pat. No. 5,172,910 to Ashurst discloses finger insert assemblies. One insert assembly of this patent is for a thumb. These devices are of woven material (see column 4, line 41 of this patent), but a resilient member is also included (see column 3, line 57). These devices are made to slip against walls of bowling-ball holes.

U.S. Pat. No. 4,273,330 to Buneta describes a bowler's finger support which is placed on a little finger. This device causes a slight displacement of a bowling ball from the finger, thereby effecting an urging of the ball toward the center of the palm. This support is of a polymer material which has a generally flexible and soft texture (see column 4, lines 16–18 of this patent).

U.S. Pat. No. 4,531,735 to Kovacs describes a bowling delivery reminder to be worn on an index finger to remind a bowler of a proper position of his hand when delivering a bowling ball. This reminder appears to be constructed of a rigid material.

U.S. Pat. No. 4,194,736 to Loafman describes a bowling device for aiding a bowler in delivering a bowling ball comprising a finger sleeve. This device appears to be worn on a little finger and is constructed of leather or artificial leather (see column 3, line 65 of this patent).

Although each of these devices aides a bowler to some extent, each of these devices also has deficiencies. In this regard, all of these devices appear to be rather expensive to manufacture, many requiring several parts which must be separately manufactured and then made to cooperate with each other. Also, most of these devices are cumbersome to carry around when they are not in use.

Still further, many of these devices are difficult to clean and some of them, if they are cleaned, are rendered less effective by this cleaning.

Yet another problem with some of these devices is that they are rather complicated and inconvenient to use.

Still another problem with most of these devices is that they do not, so far as is known, adequately improve a bowler's game such that a bowler would ignore the other problems mentioned above and use these devices. For this reason, these devices are seldom used. Instead, bowlers usually use tape which they place about their fingers and wrists in various combinations.

It is an object of this invention to provide a bowler's finger sleeve, as well as a method of its use and manufacture, which is convenient for a bowler to carry about when it is not in use, which allows a bowler to easily perform functions other than bowling when it is on his finger, which is inexpensive to manufacture, which can be easily cleaned without damaging its effectiveness, and which significantly improves the bowlers bowling game.

SUMMARY OF THE INVENTION

According to principles of this invention, a bowler places a snug rubber sleeve on a finger of his bowling hand when he grips, maneuvers, and releases a bowling ball with his bowling hand. The rubber sleeve is constructed primarily of a high density neoprene rubber to have a curve along its length, which curve is substantially the same as a natural curve of a normal relaxed finger and is worn by the bowler with the sleeve curve corresponding to the natural bend of his finger. Thus, a concave side of the bowler sleeve is the volar side thereof for contacting a volar surface of the bowler's finger. There is radially-directed internal ridge extending lengthwise along a dorsal side of the sleeve for pressing against a dorsal surface of the bowler's finger. The sleeve is constructed using the same method as is used for constructing an orthopedic splint described in U.S. Pat. No. 5,095,897 to Clark and Maurer, and it has substantially the same structure, although the sleeve is worn differently so that different elements of the structure have different functions.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is a side elevational view of a bowler's finger sleeve according to principles of this invention;

FIG. 2 is an end view of the bowler's finger sleeve of FIG. 1, taken from the right end as viewed in FIG. 1;

FIG. 3 is a side cross-sectional view of the bowler's finger sleeve of FIGS. 1 and 2, but rotated 180° therefrom, with a bowler's finger therein substantially at rest;

DESCRIPTION OF THE PREFERRED EMBODIMENT

Figure 4:
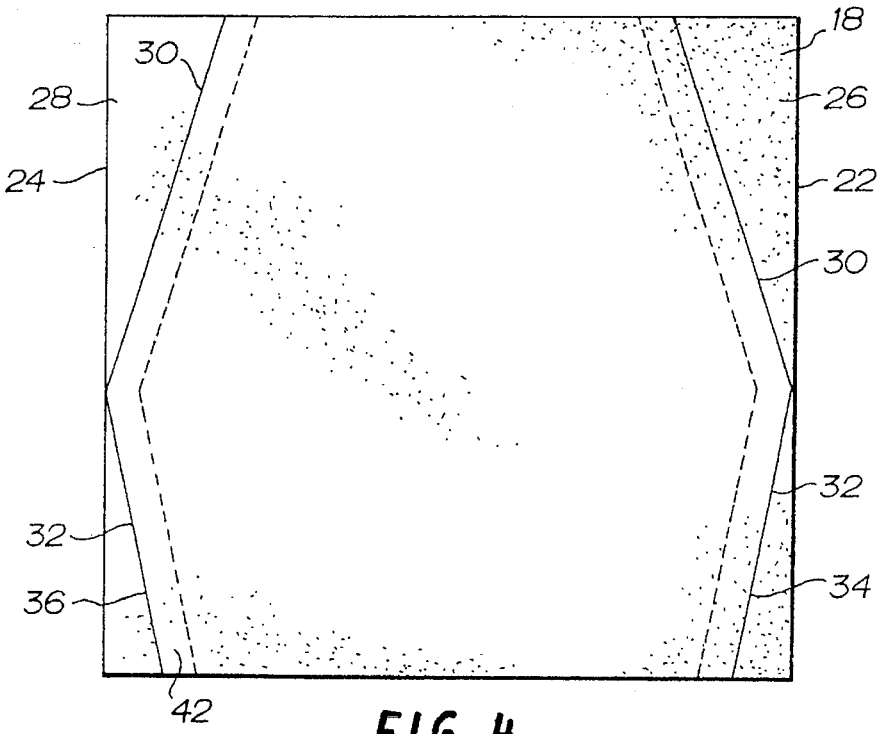
FIG. 4 is a plan view of a sheet of neoprene rubber used for making the bowler's finger sleeve of FIGS. 1, 2 and 3, with seam and cut lines indicated thereon in dashed lines.
Figure 5:
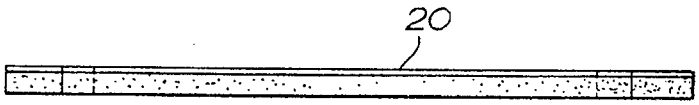
FIG. 5 is an elevational view of the sheet of neoprene rubber of FIG. 4, with cut lines being shown thereon in dashed lines.
Figure 6:
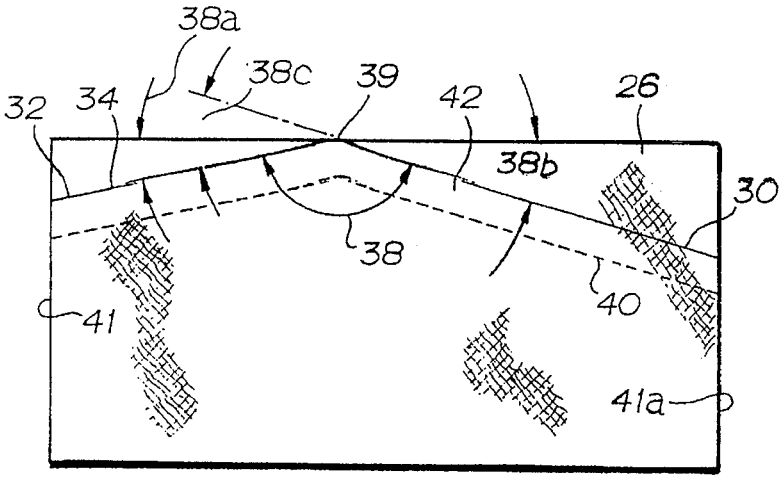
FIG. 6 is a side elevational view of a transitional tube constructed with the sheet of neoprene rubber of FIGS. 4 and 5 during a step of construction.
Figure 7:
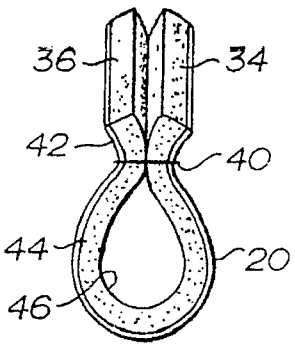
FIG. 7 is an end view of the transition tube of FIG. 6.

A curved bowler's finger sleeve 10 to be worn on a bowler's finger 12 and 12*a* is depicted in FIGS. 1, 2, 3, 8 and 9. In this regard, when the bowler's finger sleeve is worn on fingers of a bowler 14 gripping, manipulating, and releasing a bowling ball 16, the bowling ball can be much more easily controlled than with a hand not having the bowler's finger sleeve 10 thereon to bring about desired action of the bowling ball 16 as it rolls down a bowling alley. In this regard, tests have indicated that a bowler who ordinarily does not have a "hook" into a strike zone, can, nevertheless, impart a "hook" to a bowling ball with the bowler's finger sleeves of this invention.

A method of constructing the particular bowler's finger sleeve 10 of this invention is depicted in FIGS. 4, 5, 6 and 7. First, a flat sheet 18 of approximately ⅛" high-density neoprene rubber having approximate dimensions of 4"×4", lined with cloth 20 on one side, is folded on itself so that free ends 22 and 24 are adjacent one another with free-end portions 26 and 28 lying flat against one another with the cloth lining 20 being on the outside. The free-end portions 26 and 28 are simultaneously cut along lines 30 and 32 so as to create wedge, or V-shaped free edges 34 and 36. In this regard, an angle 38 of the V-shape is between 140°–160° and preferably is around 150°, with the angles 38*a* and 38*b* being 15° each. That is, this angle 38 causes the V-shaped free edges 34 and 36 to deviate from a straight line an angle 38*c* by between 20° and 40°, preferably around 30°. In one embodiment an apex point 39 of the V-shaped free edges is spaced 2" inches from a second end edge 41*a*. Thus, in one embodiment the V-shape is relatively symmetrical, although this is not necessary. A seam 40 is then stitched along the V-shaped free edges 34 and 36 leaving a seam allowance 42 of approximately ⅛ inch between the V-shaped free edges 34 and 36 and the seam 40. This creates a transition tube 44 having a transition internal passage 46. In this respect, the transition passage 46 is designed to snugly fit the finger 12 of a bowler 14. The transition tube 44 is then turned inside out to form the curved bowler's finger sleeve 10 of FIGS. 1–3. The cloth lining 20 now forms a surface 48 of a sleeve internal passage 50. The seam allowance is radially directed into the sleeve internal passage 50 at a dorsal side of the sleeve 10.

The curved bowler's finger sleeve 10 is used by sliding it onto the finger 12 with a ridge 52 formed by the seam allowance 42 being positioned on the dorsal (top side) surface of the finger 12. As can be seen in FIG. 1, when the finger 12 is not in the bowler's finger sleeve 10 the bowler's finger sleeve 10 has a curved banana shape, with a volar wall 54 being slightly bowed to have a concave external and a convex internal shape and the internal ridge 52 extending inwardly, partially collapsing the bowler's finger sleeve internal passage 50 at the dorsal wall of the sleeve. The bowler's finger sleeve 10, has a curve which is about the same as a curve of a relaxed finger of an average adult person who is to wear the bowler's finger sleeve. That is, when the bowler's finger sleeve 10 is placed on the finger 12, as is described below, it is biased to hold the finger substantially in the finger's normal relaxed position. When the bowler's finger sleeve 10 is placed on the finger 12, the internal ridge 52 presses downwardly against the dorsal surface 56 of the finger 12 and the volar surface 58 of the finger 12 is urged against the bowed volar wall 54. The combination of the internal ridge 52 and the bowed volar wall 54 prevents the bowler's finger sleeve 10 from rotating on the bowler's finger 12 even if a substantial rotational force is applied to the bowler's finger sleeve 10.

In a preferred embodiment the seam allowance 42 is approximately ⅛ inch wide.

Figure 8:
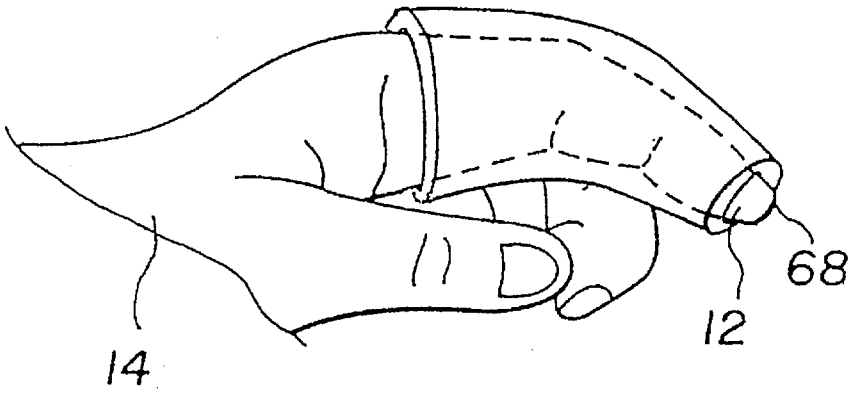
FIG. 8 is an isometric view of the bowler's sleeve of FIGS. 1 and 2 on an index finger of a bowler's hand.
Figure 9:
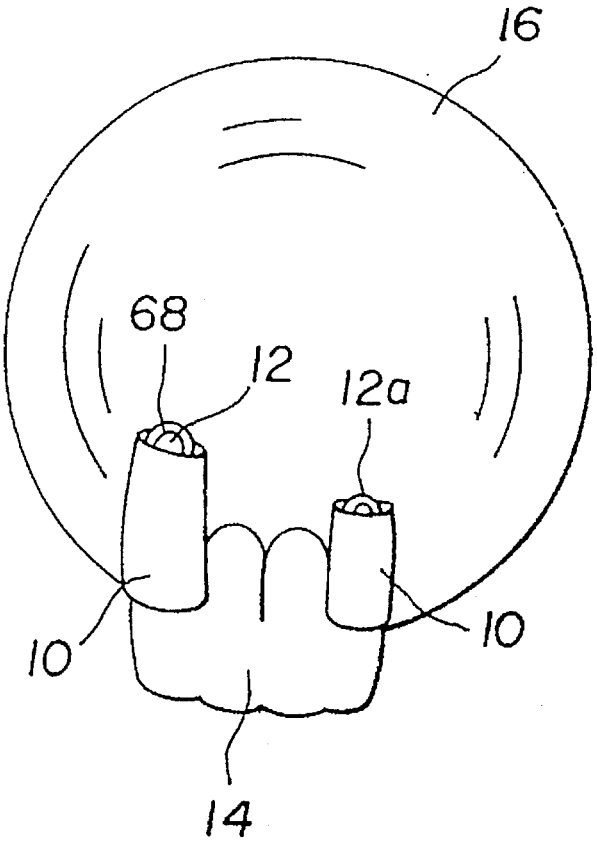
FIG. 9 is an isometric view of a bowler's hand gripping a ball with bowler's finger sleeves of this invention, as shown in FIGS. 1 and 2, on index and little fingers thereof.

One can trim the proximal end 60 of the bowler's finger sleeve 10 along dashed lines 62 in FIG. 1, for example, to fashion the bowler's finger sleeve 10 for fitting around digit web spaces of a hand. A distal end portion 64 of the bowler's finger sleeve 10 can be cut away, for example, along dashed lines 66 in FIG. 3 so that a distal end 68 of the finger 12 is exposed for use by the bowler 14, as is depicted in FIGS. 8 and 9.

Basically, the bowler's finger sleeve 10 is constructed in the same manner as is the orthopedic splint described in U.S. Pat. No. 5,095,897 to Clark et al., however, different portions of the bowler's finger sleeve 10 are used differently than are the various parts of the orthopedic splint of U.S. Pat. No. 5,095,897 to Clark et al.

The bowler's finger sleeve 10 maintains a proper position of the digits, or fingers 12 on the curved surface of the bowling ball 16 and the neoprene rubber outer surface provides a traction surface to assist the bowler in controlling and managing the bowling ball 16 when delivering it along a bowling alley. The ridge 52, formed of the interior seam allowance 42, effects a spring-like action, which further resists a bowler extending, or straightening, his finger. Thus, the bowler's finger sleeve 10 provides strength to help users maintain proper finger positions; however, it probably helps those who have weaker digits more than those with stronger digits. The interior ridge 52, formed by the seam allowance 42, also acts as a traction device on the back, or dorsal surface, of the finger 16 to prevent the sleeve from slipping, and thereby rotating on the finger 12 during bowling. This feature is quite significant because when one bowls with the bowler's finger sleeve 10, friction between the outer surface of the bowler's finger sleeve 10 and the outer surface of the bowling ball 15 tends to cause opposite forces directed toward rotating the bowling ball 16 and the bowler's finger sleeve 10. However, the bowler's finger sleeve 10 must not rotate about the bowlers' finger so that the bowler's finger sleeve 10 imparts spin to the bowling ball. The ridge 52 helps prevent the bowler's finger sleeve 10 from rotating.

The bowler's finger sleeve 10 can be easily and quickly slipped on and off a bowler's finger 12 to allow "airing" and requires no straps or adjustments when it is placed on the bowler's finger 12.

A further beneficial aspect of the bowler's finger sleeve 10 of this invention is that it can be easily and conveniently stored in a bowler's pocket or purse without occupying an undue amount of space and without deforming the pocket or purse.

Still further, the bowler's finger sleeve 10 of this invention can be constructed in an extremely uncomplicated and cost effective manner as is described above. Further, since an orthopedic splint of U.S. Pat. No. 5,095,897 to Clark et al. is already manufactured in an identical manner, the bowler's finger sleeve of this invention has the benefit of efficiency of quantity. Of course, if a company manufactures orthopedic splints of U.S. Pat. No. 5,095,897 to Clark et al. and bowler's finger sleeves of this invention on the same assembly line, they would package these products differently and sell them through different channels of commerce.

Yet another beneficial aspect of this invention is that the neoprene bowler's finger sleeve can be easily cleaned without substantially losing its outer surface friction characteristics.

It has been determined through trial in error that the bowler's finger sleeve 10 of this invention, when used on one or more fingers of bowler, as is shown in FIGS. 8 and 9, markedly improves the bowler's score by giving the bowler more control over the bowling ball.

Still further, the bowler's finger sleeve 10 of this invention allows a bowler who is wearing it to perform normal functions with his fingers, such as writing, drinking, eating, and the like without removing the bowler's finger sleeve. That is, although the bowler's finger sleeve biases a finger toward a natural relaxed finger position, it does not prevent a bowler from moving this finger to other positions by overcoming the bias. Further, since the bowler's finger sticks out the end of the bowler's finger sleeves 10, the tip of the finger, and its finger nail, can be used for picking up small items on a table.

While the invention has been particularly shown and described with reference to a preferred embodiment, it will be understood by those of ordinary skill in the art that various changes in form and detail may be made therein without departing from the spirit and scope of the invention.

For example, it may also be beneficial to use the bowler's finger sleeve of this invention as described above for other sports requiring gripping, such as tennis, baseball, golf, etc. If this were done, many of the benefits described above for bowlers would also be applicable for golfers, tennis players, and the like.

The description of the method of constructing an orthopedic splint contained in U.S. Pat. No. 5,095,897 to Clark et al. is incorporated herein by reference.

The invention claimed is:

1. A method of bowling comprising the steps of:

placing a snug rubber sleeve on a finger of a bowling hand; and gripping a bowling ball with said bowling hand so that said rubber sleeve is in firm contact with said ball; and bowling said ball with said bowling hand;

wherein said rubber sleeve placed on the finger is constructed primarily of high-density neoprene rubber;

wherein the neoprene rubber sleeve which is placed on the finger is first constructed by the method steps of:

folding a substantially flat sheet of neoprene rubber in half with free edge portions being flat against one another to form a transition tube having a transition internal passage to approximately snugly fit the finger on which said rubber sleeve is to be placed;

attaching said free edge portions together to form a seam having seam allowance;

turning said transition tube inside out so as to form the rubber sleeve having a sleeve internal passage with said seam allowance forming a radially directed ridge therealong;

wherein said step of placing said rubber sleeve on said finger of said bowling hand includes the substep of mounting said radially directed internal ridge toward the dorsal surface of the finger.

2. A method of bowling as in claim 1 wherein the neoprene rubber sleeve has a thickness greater than 1/16 of an inch and less than 1/4 of an inch.

3. A method of bowling as in claim 2 wherein the thickness is approximately 1/8 inch.

4. A method of bowling as in claim 1 wherein the step of attaching said free edge portions together is accomplished by sewing.

5. A method of bowling as in claim 1 wherein is further included in said method of constructing said rubber sleeve the step of cutting free edge portions to define a V-shaped angle of between 140° and 160°.

6. A method of bowling as in claim 5 wherein said angle of said V-shaped cut is approximately 150°.

7. A method of bowling as in claim 5 wherein of said V-shaped free edge portions define a symmetrical V.

8. A method of bowling as in claim 1 wherein said rubber sleeve is made to have a banana-like curve which is approximately like the curve of a relaxed finger.

* * * * *